United States Patent [19]

Yamasaki

[11] Patent Number: 4,973,041

[45] Date of Patent: Nov. 27, 1990

[54] SORTER FOR ACCOMMODATING COPY PAPER SHEETS

[75] Inventor: Kimihito Yamasaki, Yamatokoriyama, Japan

[73] Assignee: Sharp Kabushiki Kaisha, Osaka, Japan

[21] Appl. No.: 714,987

[22] Filed: Mar. 22, 1985

[30] Foreign Application Priority Data

Mar. 27, 1984 [JP] Japan ..... 59-59942

[51] Int. Cl.[5] ..... B65H 39/11

[52] U.S. Cl. ..... 271/288; 271/290; 271/294; 271/298

[58] Field of Search ..... 271/287, 288, 289, 290, 271/294, 296, 297

[56] References Cited

U.S. PATENT DOCUMENTS

| | | | |
|---|---|---|---|
| 4,012,032 | 3/1977 | Rogers | 271/296 X |
| 4,445,680 | 5/1984 | Kikuchi et al. | 271/296 X |
| 4,449,813 | 5/1984 | Kikuchi et al. | 271/296 X |

*Primary Examiner*—Robert P. Olszewski
*Assistant Examiner*—Matthew C. Graham

[57] ABSTRACT

A sorter for accommodating copy paper sheets which is arranged to receive copy paper sheets from a copying apparatus main body for classification and successive accommodation of the copy paper sheets onto a large number of trays, and characterized in that there is provided a memory device for storing accommodating positions of the copy paper sheets onto the trays. A control circuitry is provided for automatically selecting the tray position of the stored content of the memory device in cases of troubles such as paper jamming or running out of copy paper sheets.

5 Claims, 5 Drawing Sheets

SORTER FOR ACCOMMODATING COPY PAPER SHEETS

BACKGROUND OF THE INVENTION

The present invention generally relates to a collating arrangement for a copying apparatus and the like and more particularly, to a sorter which classifies copy paper sheets fed out of a copying apparatus for accommodation thereof onto respective rays.

Generally, in a copying apparatus, for example, an electrophotographic copying apparatus, it is so arranged that an image of an original document is formed on a photosensitive member, i.e., a photoreceptor as a visible toner image, which is then transferred onto copy paper sheets sequentially fed, and the copy paper sheets thus transferred with the toner image are thereafter passed through a fixing station so as to be subsequently discharged out of the copying apparatus. The copied paper sheets thus discharged are normally received on a tray or the like. In the above case, however, when a large number of original documents are simultaneously copied for multi-copying, it is necessary to effect collating of pages after copying.

In order to eliminate such a troublesome procedure for collating, there has conventionally been proposed for actual application, an arrangement in which a sorter is coupled to a copy paper sheet discharge port of a copying apparatus, thereby to sequentially classify and accommodate the copy paper sheets after completion of the copying, onto respective trays constituted in a plurality of stages.

In the sorter as referred to above, there is one type which is adapted to be driven and controlled according to instructions from the copying apparatus main body, and another type which is arranged to detect discharged copy paper sheets independently by the sorter itself for driving and control thereof. The sorter of the former type is formed into one unit with the copying apparatus, and is so constructed that, although the sorter itself may be separated from the copying apparatus, copy operation can not be effected unless the sorter has been mounted onto said copying apparatus. On the contrary, since the sorter of the latter type does not have a particular interface with respect to the copying apparatus main body, it can be very easily separated from the copying apparatus, thus remarkably improving exchangeability of trays in the normal applications.

However, although the sorter which is not provided with the interface between said sorter and the copying apparatus can readily cope with alterations in the number of paper sheets to be copied, if paper jamming or running out of copy paper sheets takes place at the side of the copying apparatus main body, transport time interval between copy paper sheets becomes longer than a predetermined time interval, and therefore, the uppermost tray is selected so as to guide following copy paper sheets successively onto subsequent trays for accommodation. In other words, if the transport time interval between the copy paper sheets which are being fed, exceeds the predetermined time interval, the sorter main body effects control to select the uppermost tray. However, if the prolonged transport time interval results from any troubles at the side of the copying apparatus main body, there is a problem in resetting to the uppermost tray. Therefore, it has been a common practice to manually select the trays after remedy of the troubles in the copying apparatus main body so as to guide and accommodate copy paper sheets successively fed, onto the trays at proper places. In this manner, the sorter which is not provided with the interface requires the procedure as described above, which is very troublesome and inconvenient.

SUMMARY OF THE INVENTION

Accordingly, an essential object of the present invention is to provide an improved sorter for accommodating copy paper sheets, which is of a type without an interface with respect to a copying apparatus main body, and still has an operability equal to a sorter of a type formed into one unit with the copying apparatus main body and controlled as part of the copying function.

Another important object of the present invention is to provide a sorter of the above described type which is simple in construction and stable in functioning at high reliability, and can be readily applied to copying apparatuses of various types at low cost.

In accomplishing these and other objects, according to one preferred embodiment of the present invention, there is provided a sorter for accommodating copy paper sheets, which is arranged to receive copy paper sheets from a copying apparatus main body for classification and successive accommodation thereof onto a large number of trays, and characterized in that there is provided a memory means for storing accommodating positions of the copy paper sheets onto said trays. A control means is provided for automatically selecting the tray position of the stored content of the memory means in cases of troubles such as paper jamming or running out of copy paper sheets.

By the arrangement of the present invention as described above, an improved paper sheet accommodating sorter has been advantageously presented, with substantial elimination of disadvantages inherent in the conventional sorter of this kind.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
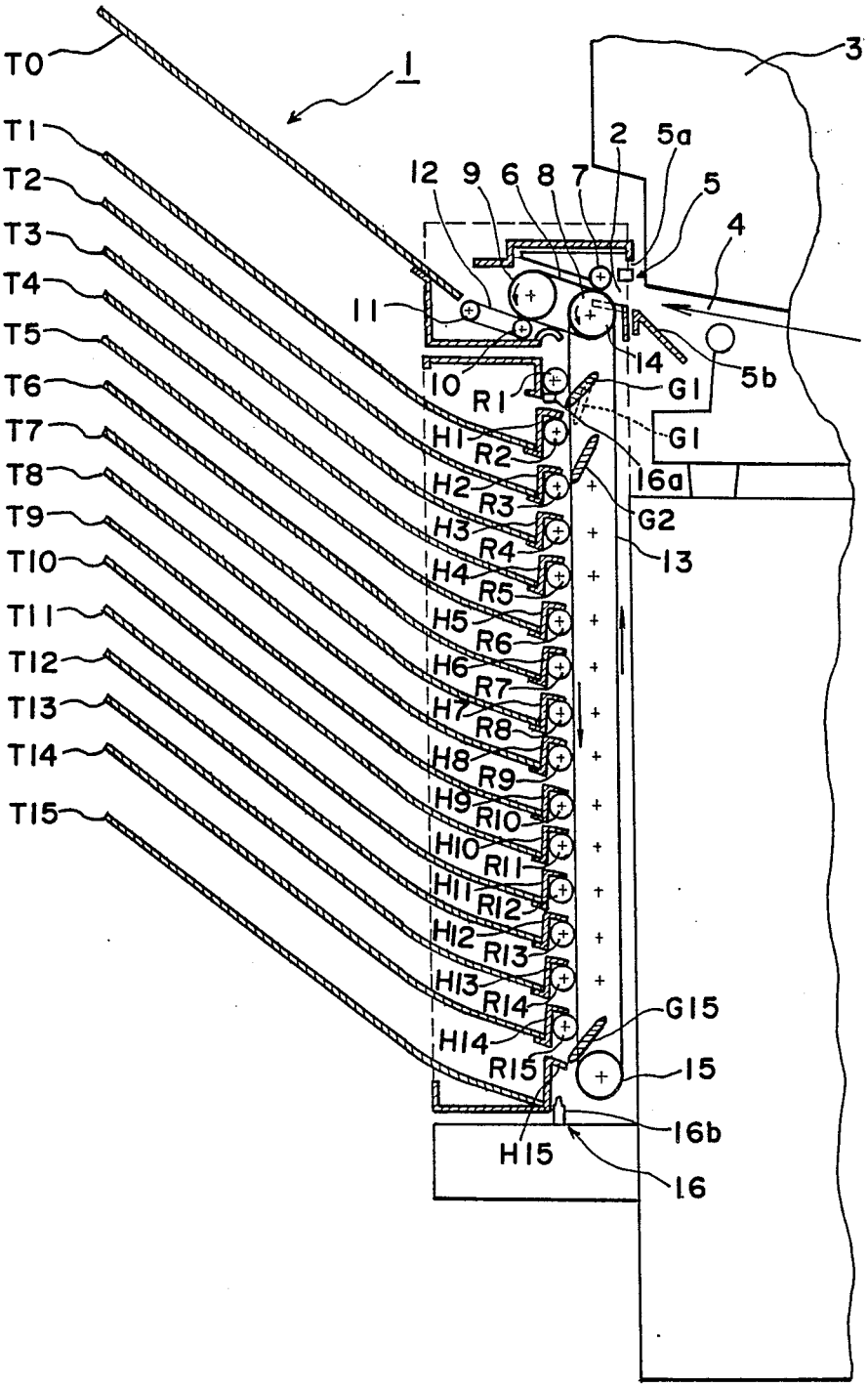
FIG. 1 is a schematic side sectional view showing construction of a sorter for accommodating copy paper sheets according to one preferred embodiment of the present invention.

Before the description of the present invention proceeds, it is to be noted that like parts are designated by like reference numerals throughout the accompanying drawings.

Referring now to the drawings, there is shown in FIG. 1 a sorter 1 for accommodating copy paper sheets, coupled with a copying apparatus main body 3 and including transport belts 6, 12 and 13, and a plurality of trays T0 and T1 through T15, etc. for classification of copy paper sheets in the manner to be described hereinafter.

The sorter 1 is mounted on the copying apparatus main body 3, with a paper sheet receiving port 2 of a main body of the sorter 1 confronting a paper sheet discharge port 4 of the copying apparatus main body 3. In the receiving port 2 of the sorter 1, there is provided a paper sheet entry detecting sensor 5 including a light emitting element 5*a* and a light receiving element 5*b*. Meanwhile, in a carry-in section for carrying the discharged copy paper sheets into the sorter 1, there are provided the transport belt 6 and a guide roller 7 held in contact therewith. The transport belt 6 is movably supported by a pulley 8 to which a rotational force from a driving source, i.e., a main motor (not shown) of the sorter 1 is transmitted, and another pulley 9. Accordingly, upon rotation of the pulley 8, the transport belt 6 is caused to run, and the guide roller 7 held in contact with the belt 6 is also rotated.

Copy paper sheets transported by the above transport belt 6 are introduced onto a temporary accommodating tray T0, which is inclined as shown in FIG. 1 so that trailing edges of the copy paper sheets (not particularly shown) thus fed are held in a drooping or hanging down state. Corresponding to the inclined lower portion of the temporary accommodating tray T0, there is provided the transport belt 12 movably supported between pulleys 10 and 11. The transport belt 12 is provided at such a position as to hold the copy paper sheet between the upper run thereof and the under run of the transport belt 6 for transportation, particularly in such a manner that the pulleys 9 and 10 confront each other for pressure contact between the transport belts 6 and 12. There is further provided another transport belt 13 in a position confronting the belt 12 so as to transport the copy paper sheets being fed by the transport belt 12 in a vertical direction. The transport belt 13 is movably directed around an upper pulley 14 provided on the same shaft as for a driving shaft of the driving pulley 8 and a lower driven pulley 15. In positions corresponding to the above transport belt 13, there are provided the trays T1, T2, T3, T4, T5, T6, T7, T8, T9, T10, T11, T12, T13, T14 and T15 respectively for accommodating the classified copy paper sheets thereon.

The above trays T1 through T15 are disposed at predetermined intervals so as to constitute storing shelves in fifteen stages for storing the classified copy paper sheets, and each fixed in the inclined state generally parallel to the temporary accommodating tray T0 so that the outer side edges thereof are directed slantwise upwardly. At the lower edges of the respective trays T1 through T15, there are fixed hangers H1, H2, H3, H4, H5, H6, H7, H8, H9, H10, H11, H12, H13, H14 and H15 for guiding the classified copied paper sheets smoothly onto the trays and also for supporting the copied paper sheets accommodated on said trays. Adjacent to sheet guide pieces of the respective hangers H1 through H15, transport rollers R1, R2, R3, R4, R5, R6, R7, R8, R9, R10, R11, R12, R13, R14 and R15 are arranged in a vertical direction. The vertical transport belt 13 is passed around the pulleys 14 and 15 as described earlier, with the belt surface thereof confronting the transport rollers R1 through R15, whereby the copied paper sheets are held between the transport rollers R1 to R15 and the surface of the vertical transport belt 13 so as to be fed vertically downwardly. In other words, the above vertical transport belt 13 and the transport rollers R1 through R15 constitute a classification passage which holds the copied paper sheets therebetween for transport thereof from the upper portion to the lower portion so as to be successively introduced onto the trays T1 through T15. For the above classification, there are pivotally provided gate claws G1 through G15 (gate claws G3 to G14 are not particularly shown) in positions adjacent to the respective hangers H1 through H15 in this classification passage, and by the pivotal movements or open/close functions of said gate claws G1 through G15, the copied paper sheets are led onto any of the trays T1 to T15 corresponding to the function of the gate claws. The gate claws G1 through G15 are each subjected to the open/close functions between one direction for leading the copied paper sheets fed by the vertical transport belt 13 and the transport rollers R1 through R15 onto the corresponding tray, and the other direction for leading them onto a subsequent tray. Although not particularly shown, there is provided a shifting mechanism for shifting the open/close functions sequentially from the gate claw G1 at the uppermost position so that the copied paper sheets may be introduced into the required trays. It is needless to say that the gate claw G15 corresponding to the lowermost tray is directed towards the tray T15 at all times, since said claw G15 is not required to feed the copied paper sheets to a subsequent tray. In other words, continuously copied paper sheets after the fifteenth sheet are all accommodated onto the last tray T15. In a position where the copied paper sheets are fed onto the respective classification trays T1 through T15, i.e., in a position corresponding to the respective hangers H1 through H15, there is disposed a paper sheet detecting sensor 16 including a light emitting element 16*a* and a light receiving element 16B.

Subsequently, functionings of the sorter having the construction as described above will be explained hereinbelow.

In the copying apparatus 3, when the number of paper sheets to be copied is set and the copying operation is started, entry of the copied paper sheets is detected by the sensor 5 so as to start the motor (not shown) for driving the respective transport belts 6, 12 and 13. Such driving of these transport belts and shift function of the respective gate claws G1 through G15 are effected based on a control by a micro-computer provided in a control section (to be described later) within the sorter 1.

At first, each of the paper sheets fed from the copying apparatus 3 is led into the temporary accommodating tray T0 by the movement of the transport belt 6. When a trailing edge of the copy paper sheet has passed through the transport belt 6, the trailing edge is transferred onto the transport belt 12, and thus, the paper sheet is directed, from its trailing edge, towards the vertical transport belt 13 through movement of the transport belt 12. As described above, since the paper sheet is adapted to be fed out towards the vertical transport belt 13 in a direction opposite to that for the temporary accommodation after having been once accommodated on the temporary accommodating tray T0, such paper sheet is transported to the corresponding tray, with its leading edge and trailing edge during the entry being reversed, and thus, it becomes possible to accommodate the paper sheets on the trays in a turned over state, with its upper surface and under surface inverted.

At the starting of sorting, only the gate claw G1 of the respective gate claws is directed towards the tray T1, and the paper sheets are transported onto the tray T1 along said gate claw G1. As described earlier, since the paper sheets are directed in the direction opposite to that during the entry through the temporary accommodating tray T0, they are accommodated on the tray T1 in the turned over state. In the vicinity of the respective hangers H1 to H15, the paper sheet detecting sensor or shift sensor 16 is provided for detecting passing of the paper sheet, and upon detection of the leading edge of the paper sheet transported onto the tray T1 by the shift sensor 16 provided adjacent to the hanger H1, the gate claw G1 is shifted in a direction of closing the gate as indicated by a dotted line by the time a subsequent paper sheet reaches the classification passage, while the gate claw G2 at the subsequent stage functions to open the gate for the tray T2.

By sequentially repeating the reversing/accommodating function and shifting function as described so far, the number of paper sheets preset in the copying apparatus 3 is successively accommodated onto the trays from the upper trays towards the lower trays. It is to be noted here that, when the entry detecting sensor 5 does not detect entry of paper sheets for a predetermined period of time, the state is judged as completion of a series of multi-copying operation, etc., and the driving of the transport belts is suspended, while the shifting function of the gate claws is reset so as to restore the first stage gate claw G1 into the state for opening the tray T1 as shown by a solid line in FIG. 1.

Figure 2:
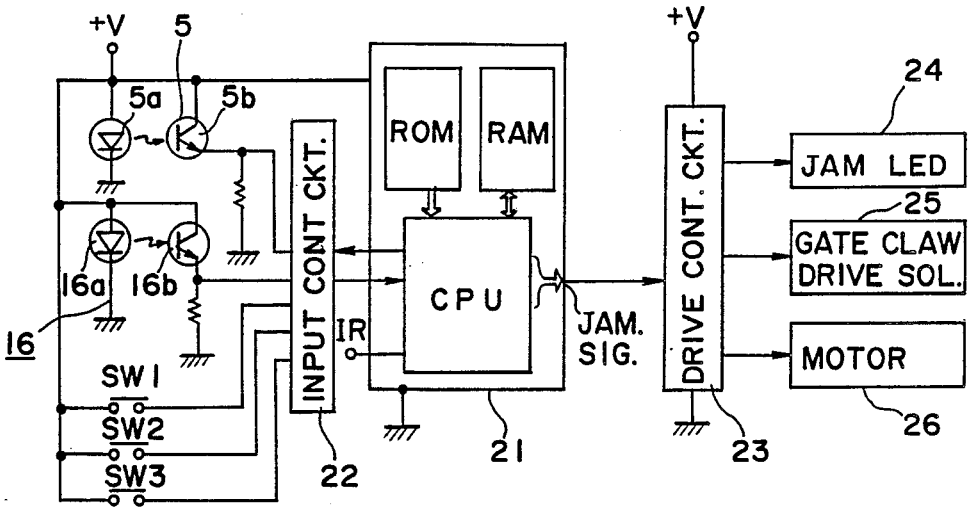
FIG. 2 is an electrical block diagram showing one example of a driving control circuitry of the sorter according to the present invention.

Referring also to FIG. 2, there is shown a driving control circuit for the sorter 1 according to one preferred embodiment of the present invention, which generally includes a micro-computer, i.e., main control circuit 21 which is coupled to an input control circuit 22 and a drive control circuit 23, etc. in a manner as described hereinbelow. The main control circuit 21 further includes a ROM (read only memory) in which programs for the sorting control are stored, a RAM (random access memory), and a CPU (central processing unit) for successively reading out instructions stored in the ROM so as to decode the instructions and also to produce control signals corresponding to the input state. The main control circuit 21 applies strobe signals to the input control circuit 22 coupled thereto, and thus, takes in input signals from said input control circuit 22. Meanwhile, the control circuit 21 applies control signals corresponding to the state of input, to the drive control circuit 23 coupled therewith, and said drive control circuit 23, in turn, drives and controls a jam LED (light emitting diode) 24, driving solenoids 25 for the gate claws, and a motor 26 respectively connected to the drive control circuit 23. The driving solenoids 25 for the gate claws are provided to correspond to the respective gate claws G1 through G14, and upon driving of the required one thereof, the gate claw G1 is directed towards the first tray T1 for guiding the paper sheets. The above gate claws G1 through G14 are normally urged to be located in the state of the gate claw G2 in FIG. 1.

The input control circuit 22 is coupled to the paper sheet entry detecting sensor 5 having the light emitting element 5*a* and light receiving element 5*b*, paper sheet detecting sensor 16 having the light emitting element 16*a* and light receiving element 16*b*, and switches SW1, SW2 and SW3 as shown. The switch SW1 is a change-over switch for setting the sorter 1 selectively into a sort mode or non-sort mode, and if the sorter 1 has been set in the sort mode, it is set into the non-sort mode by the operation of the switch SW1, and when the switch SW1 is again operated in this mode, the sorter 1 is reset back into the sort mode. The switch SW2 is a shift switch for the trays for successively shift-setting the respective trays manually. For example, when the top tray T1 has been set, if the above switch SW2 is once operated, the next tray T2 is to be set, and particularly, the gate claw G2 is driven by the solenoid to guide the paper sheets into the tray T2. Meanwhile, the switch SW3 is a reset switch for the sorter jamming, and by actuating this switch SW3 after treatment of the sorter jamming, etc., the sorting function may be resumed.

Figure 3:
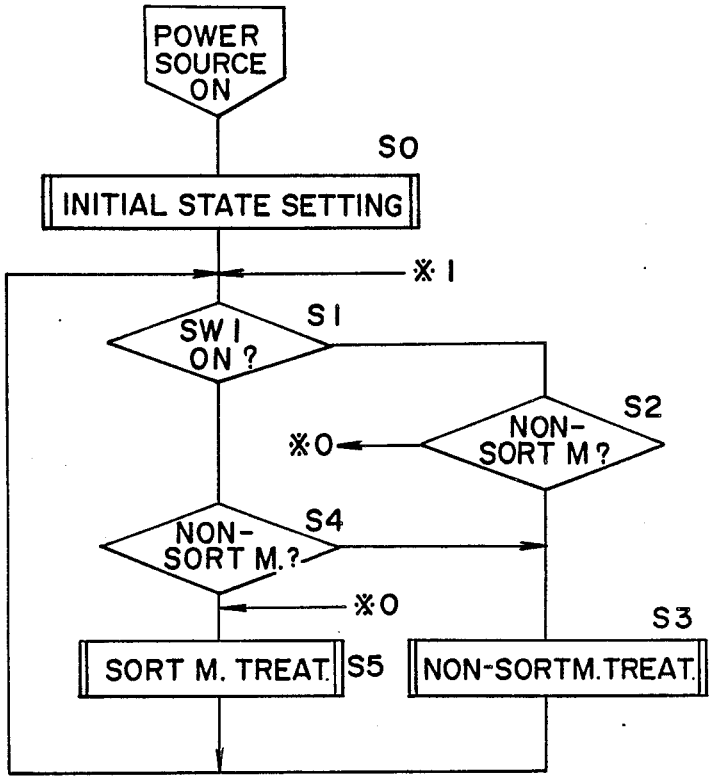
FIG. 3 is a flow-chart for explaining control functions of the sorter of FIG. 1.

By the circuit construction as described so far, the control functions of the sorter 1 according to the present invention will be described in detail hereinbelow with reference to the flow-charts of FIGS. 3 and 4(*a*) and 4(*b*).

Upon turning on a power source for the sorter 1, an initial signal IR at that time is applied to the control circuit 21, which then executes a processing for the initial setting (step S0). By the above processing, the sorter 1 is set to the non-sort mode.

Subsequently, the procedure proceeds to step S1, and the control circuit 21 checks whether or not the mode change-over switch SW1 has been operated. The above check is effected by applying a strobe signal from the control circuit 21 towards the input control circuit 22, thereby to send the signal for turning on or off the switch SW1, from the side of the input control circuit 22 to the control circuit 21. Now, if the above switch SW1 has not been operated, the procedure :s advanced to step S2 for checking whether or not the mode is the non-sort mode. In the above case, since the mode is set to the non-sort mode after turning on the power source, for example, "0" is stored in the designated area of the RAM, and by judging whether the designated area of said RAM is "1" or "0" by the CPU, if it is "0", the state is judged as in the non-sort mode, and the procedure is advanced to step S3 for effecting the non-sort mode processing.

In the non-sort mode, copy paper sheets fed from the copying apparatus are all accommodated on the top tray T1. More specifically, during the non-sort mode, only the solenoid corresponding to the gate claw G1 is driven so as to guide the paper sheets onto the tray T1, with the shift mechanism not being driven. In this state, when the shift switch SW2 is once depressed, the next gate claw G2 is actuated to guide the paper sheets onto the tray T2. By depressing this switch SW2 several times, the gate claws are successively shifted for sequential selection of the required trays. Described so far is the function control during the non-sort mode.

Subsequently, the control functions during the sort mode will be described.

In the first place, if it is detected that the switch SW1 is operated at step S1, the procedure proceeds to step S4 to effect the checking similar to that in step S2 described earlier, and upon depression of the switch SW1 in the state of non-sort mode, the procedure is shifted to step S5 to execute the sort mode processing. Here, if the mode is set to the sort mode state, "1" representing the sort mode is stored in the designated area of RAM as explained previously.

Figure 4A:
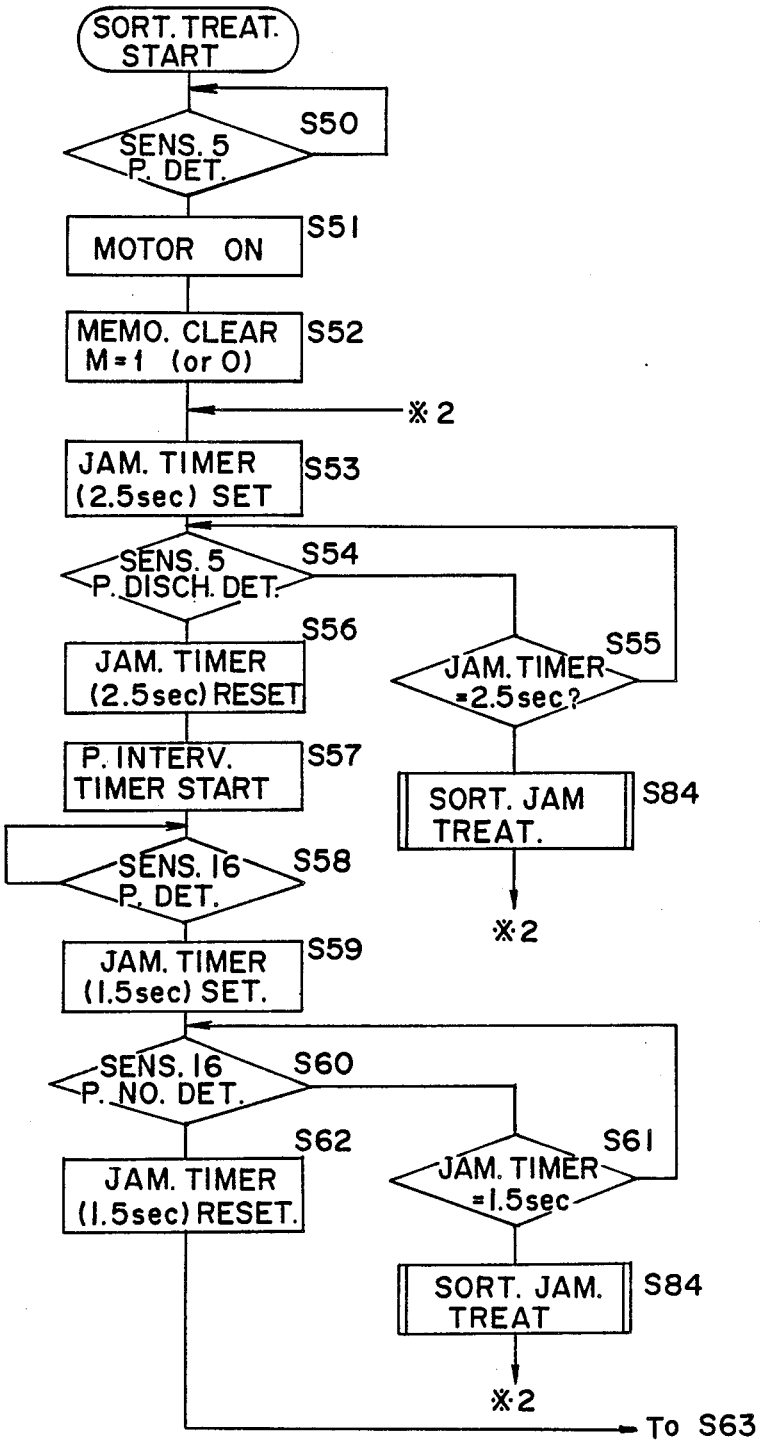
FIGS. 4(*a*) and 4(*b*) are also a flow-chart for explaining sorting control functions of the sorter of FIG. 1 (FIG. 4(*a*) continues onto FIG. 4(*b*))
Figure 4B:
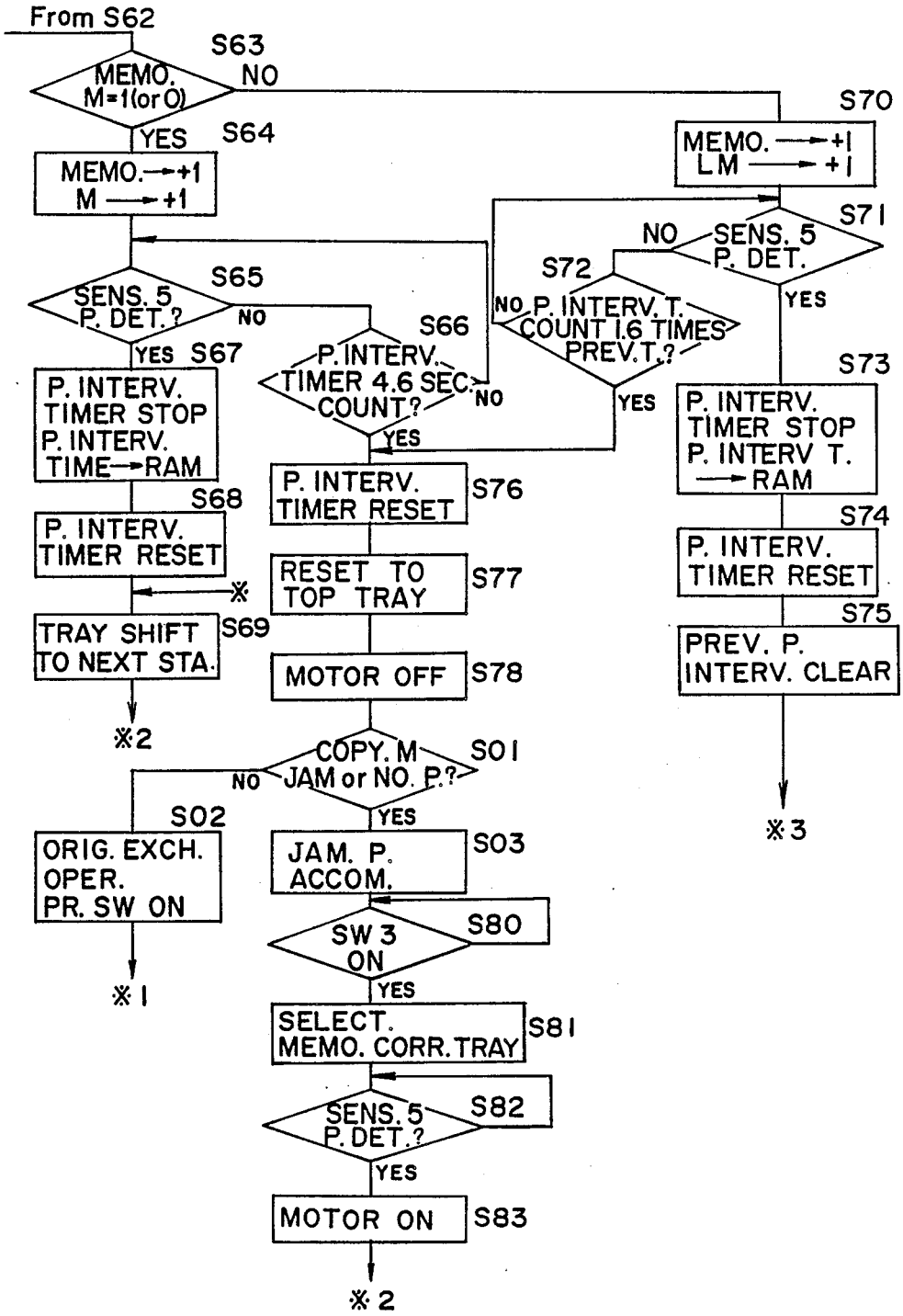

Details of the above sort mode processing control are shown in FIGS. 4(*a*) and 4(*b*).

Firstly, at step S50, checking by the sensor 5 for detecting whether or not the copied paper sheet is fed from the copying apparatus 3 is executed. For the above purpose, it is so arranged that, when the copied paper sheet is fed between the elements 5*a* and 5*b* shown in FIG. 2, the output of the light receiving element 5*b* is inverted, thereby detecting the arrival of the copy paper sheet. Here, in order that the change-over operation for the sort mode or non-sort mode becomes effective before the copied paper sheet is fed into the side of the sorter 1, if the paper sheet has not been detected after the checking at step S50, the procedure is reverted to step S1 in FIG. 3 for checking the state of operation of the switch SW1. In this case, if the sensor 5 detects the paper sheet at step S50, it is judged that the paper sheet has been carried into the sorter side, and the control signal is applied to the drive control circuit 23 for driving the motor 26. Accordingly, the motor 26 is rotated to drive the transport belts 6, 12 and 13 at the sorter side, and thus, the paper sheets carried in are transported onto the trays along the particular gate claws G. In this case, the content of the memory in which the tray positions are stored is cleared, and the memory is reset to the initial state (step S52). Therefore, the gate claw G1 is positioned by the solenoid driving as indicated by the solid line in FIG. 1. Simultaneously therewith, a jam timer is set at step S53. The memory as referred to above is arranged to memorize in a specific area of the RAM through addition in +1 by +1, and is counted up by the signal from the detecting sensor 16 for detecting that the paper sheet is accommodated on the top tray T1.

Meanwhile, based on the fact that the processing time of one instruction for the CPU is determined, the jam timer is constituted by counting the number of processings (time) of such instruction each time so as to be stored in the RAM. The time setting for the above jam timer is effected in such a manner that, since the time required from the detection of the paper sheet at the sensor 5 until the passage of this paper sheet through said sensor 5 (i.e., until the non-detected state is reached) is constant for the paper sheets of the same size, the jam timer is set for the time by including an allowance range in the time required for a maximum sized copy paper sheet to pass therethrough. In the present embodiment, the set time is assumed to be 2.5 sec for brevity of explanation.

When the jam timer is set in the manner as described above, it is subsequently checked at step S54 whether or not the state is for the non-detection of the paper sheet. In this checking, if the paper sheet being transported is still detected by the sensor 5, the procedure proceeds to step S55 for checking whether or not the jam timer has counted 2.5 sec. In the case where the sensor 5 is detecting the paper sheet even when the jam timer has counted 2.5 sec, treatment for the sorter jamming is effected, which will be described in more detail later. Now, if the paper sheet passes through the sensor 5 before the jam timer counts 2.5 sec, the jam timer is reset by skipping step S54. If the sensor 5 detects the trailing edge of the paper sheet, a paper sheet interval timer is set by the signal input (S57). This paper sheet interval timer is intended to count the time interval from the trailing edge of a preceding paper sheet to the leading edge of a subsequent paper sheet, and the counted time is stored in the RAM each time. The above paper sheet interval timer starts the time counting from the time point when the detecting sensor 5 has detected the trailing edge of the paper sheet, and stops the time counting upon detection of the leading edge for the subsequent paper sheet. According to the time counted as described above, the treatments according to the present invention are effected as follows.

After the control circuit 21 has effected the control as explained above, the procedure is advanced to step S58 so as to check the paper sheet detecting state by the paper sheet detecting sensor 16. Normally, upon arrival at the sorter side, the copied paper sheet is first fed into the tray TO by the transport belt 6 and the guide roller 7, and thereafter, held between the transport belts 6 and 12 at the trailing edge thereof so as to be transported in the opposite direction. Thus, when the paper sheet is transported in the vertical direction through the vertical transport belt 13, it is guided onto the top plate T1 by the action of the gate claw G1. In the above case, if the paper sheet is present between the light emitting element 16*a* and the light receiving element 16*b* during feeding onto the tray, the signal indicative of detection of the paper sheet by the sensor 16 is applied to the control circuit 21. Accordingly, the control circuit 21 subsequently proceeds to step S59 to set the jam timer. This jam timer has been set for the time in which the maximum-sized copy paper sheet is accommodated on the tray, and owing to the fact that the paper sheet transporting speed at the sorter side is generally set to be higher than that at the copying apparatus side, the set time of the above jam timer becomes shorter than that of the 2.5 sec timer described earlier.

Particularly, while the copy paper sheet is transported by extending over the transport system at the copying apparatus side and that at the sorter side, the copy sheet is to be transported at the speed depending on the transport system at the copying apparatus side. Therefore, the transport belt 6 and the side roller 7 are arranged to effect a slip transportation, and when the action by the transportation at the copying apparatus side is lost, the copy paper sheet is transported according to the speed of the transport belt 6. Accordingly, for the description of the present embodiment, in the jam timer for the sensor 16, the time required for the entire length of the copy paper sheet to be accommodated on the tray is set to be 1.5 sec. It is to be noted here, however, that the above time may be determined depending on necessity, and is not limited to 1.5 sec alone.

When the jam timer by the sensor 16 is set as described above, it is again checked whether or not the sensor 16 is effecting the non-detection of the paper sheet, and if the copy paper sheet is detected, checking as to whether or not the jam timer has counted 1.5 sec at step S61 is effected. If the paper sheet passes through the sensor 16 by the time the jam timer counts 1.5 sec, the jam timer is reset at step S62 by skipping over step S60. In the manner as described above, when the accommodation of the first copy paper sheet onto the top plate T1 has been completed, the memory content for the tray positions within the RAM is checked (step S63). Here, the top plate T1 is still being selected, with the content of the above memory remaining at the initial state "1" (or "0"), and at the subsequent step S64, +1 is effected to the memory so as to render the content thereof to M=2 (or 1), and thus, the procedure is advanced to step S65. In this step S65, the next copy paper sheet transported to the sorter side is detected by the sensor 5, and upon detection of the introduction of the paper sheet by the sensor 5, the procedure proceeds to step S67. However, if the sensor 5 is not detecting the next copy paper sheet, it is checked whether or not a paper sheet interval timer in step S66 has counted 4.6 sec, and the step is again shifted to step S65. Here, judgement is made as to whether or not the next paper sheet has arrived at the receiving port 2 of the sorter 1 before the paper sheet interval timer has counted 4.6 sec, and if not, the state is regarded as the exchanging procedure of original documents so as to effect the sorter control to be described later. In the above case, the time for the paper sheet intervals preset as described above is determined by including an allowance to a certain extent in the maximum time for the paper sheet intervals during the multi-copying of the copying apparatus, and is assumed to be 4.6 sec for the explanation of the present embodiment.

As described so far, if the sensor 5 detects the next copy paper sheet before the paper sheet interval timer counts the predetermined time, the procedure is advanced to step S67, with the time counting function of the paper sheet interval timer previously set being suspended, and the time content at the time is stored in the designated area of the RAM. Then, at step S68, the paper sheet interval timer is reset to prepare for a subsequent time counting, and thereafter, at step S69, the tray is shifted by one stage. More specifically, the solenoid for the gate claw G1 is deenergized, and another solenoid corresponding to the gate claw G2 is driven for selecting the subsequent tray T2, while the gate claw G1 is returned to the position indicated by the dotted line in FIG. 1. In other words, the tray is shifted to the tray T2 at the next stage. It is to be noted here that the paper sheet interval time counted this time is stored in the RAM for comparison of the subsequent paper sheet intervals.

Subsequently, when the next paper sheet is fed to the sorter side, the procedure is reverted to step S53, and the jam timer (2.5 sec) is set to repeat the control function as described above, with the next paper sheets being accommodated onto the tray T2. In the above case, since the paper sheet is guided so as to be accommodated on the tray T2 and the tray position memory portion of the RAM stores "M=2 (or 1)" during the previous functioning, the procedure proceeds from step S63 towards step S70, to effect "+1" to the memory portion. Then, the step is shifted to step S71 so as to check whether or not the sensor 5 has detected the paper sheet. In this case, if the copy paper sheet has not arrived at the receiving port 2 of the sorter 1 as yet, with the sensor 5 being in the state of non-detection of the paper sheet, the procedure is shifted to step S72 so as to check whether or not the paper sheet interval timer has counted time 1.6 times that for the previous paper sheet interval. By this checking at step S72, it is judged whether or not the present copy paper sheet interval is within 1.6 times that of the previous copy paper sheet interval. This function is effective particularly when the copying apparatus 3 is provided with a duplex or double image face copying function, which is so arranged that by dividing an original document placing face into ½, when copying is effected for the preset number of sheets for a first half original document, copying for the preset number of sheets for a second half original document is subsequently effected. At this time, when the operation is shifted from the first half copying to the second half copying, the paper sheet interval time becomes considerably longer than that in the first half copying. For the judgement of the above state, the time for the paper sheet interval is counted. For example, on the assumption that the copy paper sheet interval during shifting from the first half copying to the second half copying is about 1.6 times the copy paper sheet interval during the normal multicopying, if the present paper sheet interval is within 1.6 times, in time, with respect to the previous paper sheet interval, it may be processed as a continuation of the multi-copying, while if the present paper sheet interval is longer than the previous paper sheet interval, it may be dealt with as the latter half copying function. In the above case, a similar situation applies to the exchanging operation of original documents.

In the above case, if the sensor 5 detects the next paper sheet (third paper sheet) when the paper sheet interval timer has counted the time 1.6 times that for the previous paper sheet interval, the procedure is advanced to step S73, and the time counting by the timer counting the paper sheet intervals up to that time is suspended, and furthermore, the time counted by the timer at that time is memorized in the RAM, with a subsequent resetting of the paper sheet interval timer (step S74). Then, the procedure is shifted to step S75, and the content of the RAM storing the previous paper sheet interval is cleared, and only the time for the present paper sheet interval is memorized so as to be utilized for the next comparison. Thereafter, the procedure is shifted from step S69 to step S53 to set the jam timer. In the above case, since the jam timer is set through many steps after the paper sheet detection by the sensor 5 (step S65 or S71), the time for the timer may be considered to vary, different from that during the jam timer setting period after step S50. However, owing to the fact that the treating time in the respective steps is very short, such a difference is of course included in the allowable range of the jam setting time, thus inviting no particular problems. Meanwhile, the jam timer is set for the time, with the time as referred to above taken into consideration.

The functionings as described above are repeated, and for example, in the case where multi-copying for twenty sheets is being effected, after accommodation of a fourteenth copy paper sheet into the tray T14, the remaining six same copy paper sheets are accommodated in the last tray T15. At this time, all the solenoids are de-energized with the shift mechanism for the trays not functioning thereafter, and such a state is continued until a series of multi-copying is completed. Thus, if the copying interval becomes longer than the predetermined interval, it is regarded that a series of multi-copying functioning has been completed, and the top tray T1 is selected, with the content of the memory being all cleared. More specifically, when the duplex or double image face copying referred to earlier is being effected, the paper sheet interval for effecting the latter half copying after completion of the copying for the first half image, becomes longer than the predetermined interval (i.e., at 1.6 times). Therefore, the procedure is advanced to step S76 after checking at step S72 to reset the paper sheet interval timer, and at step S78, the gate claw G1 corresponding to the top plate T1 is selected. In this case, since the exchanging operation of the original documents, etc. is not effected by an operator, the treatments at steps S01 and S02 are not made by the operator after turning off the motor, with the procedure being reverted to step S1 in FIG. 3.

Particularly, step S01 is to be effected based on the judgement by the operator, and when there is no trouble at the side of the copying apparatus, the procedure is advanced to step S02, and the operator executes the original document exchanging operation. However, in the case of the double image face copying, the subsequent copying function for the latter half is effected without exchanging the original document, and therefore, the procedure is immediately shifted from step S77 towards step S78 and step S1 to execute the control function as described above.

Meanwhile, instead of the double image face copying, upon completion of the normal multi-copying, the operator effects the original document exchanging operation for copying the next original document, and starts the copying function of the copying apparatus. Therefore, the functions described above such as reverting to step S1, and advancing to step S50 for detection of the copy paper sheets, with the subsequent turning on of the motor and clearing of memory (step S52), etc. are to be repeated.

Here, in the case of trouble at the side of the copying apparatus main body, if the state of the trouble relates to paper sheet jamming, running out of paper sheets or the like, the operator executes the jam treatment or paper sheet accommodation treatment (step S03) by referring to the trouble indication at the copying apparatus main body side, and upon completion of such a treatment, actuates the jam reset switch SW3 at the sorter side. By the above operation, the actuation of the switch SW3 is detected at the sorter side, and the memory content storing the sorter position within the RAM is read out so as to actuate the corresponding gate claw for effecting the accommodation of the copy paper sheets onto the tray corresponding to said memory content. Thereafter, when the paper sheet detection (step S82) by the sensor 5 is effected, the motor is turned on (step S83), and the procedure is reverted to step S53 to execute the functions described earlier. In this case, the memory content for the tray position within the RAM remains to be memorized without being cleared for selecting the predetermined tray. In other words, in the case of trouble at the side of the copying apparatus, the tray is held under the state before occurrence of the trouble at all times.

Figure 5:
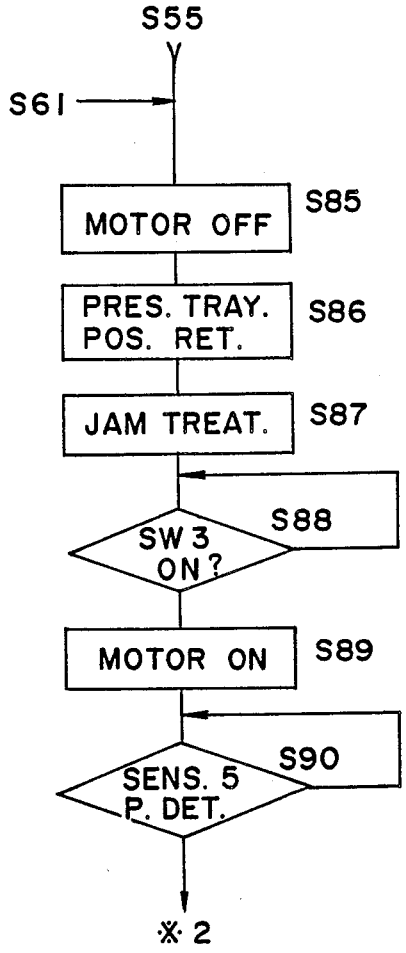
FIG. 5 is also a flow-chart during a paper jamming treatment for the sorter of FIG. 1.

Subsequently, description will be made describing the case where a sorter jamming has taken place at the side of the sorter 1. The sorter jamming is detected at positions of the sensors 5 and 16 and if the time required for the copy paper sheet to pass the positions as detected by the sensors 5 and 16 is longer than the preset time, the state is treated as jamming. More specifically, after the jam timer setting at step S53 or S59, during the checkings of steps S54→S55 or S60→S61, if the sensor 5 or 16 has detected the paper sheet after completion of counting of 2.5 sec or 1.5 sec by the jam timer, jam treatment at step S84 (FIG. 4(*a*)) is executed, the details of which are shown in a flow-chart of FIG. 5. As illustrated in FIG. 5, the motor is first turned off to stop the transportation of the copy paper sheets, while the function is suspended, with the selection position for the tray being retained (steps S85, S86). Then, after effecting the jam treatment (step S87) by the operator himself, the state of actuation of the jam reset switch SW3 is checked (step S88), and the motor is turned on (step S89) after operation of the switch SW3 so as to return to the normal sorting function as described earlier. During such sorter jamming, it is preferable to stop the copying function at the copying apparatus main body. For this purpose, it is so arranged that, during the sorter jamming, a jam signal JA (e.g. "High" signal) is applied to the copying apparatus main body, at which the copying function is suspended upon receipt of the jam signal JA. Moreover, a jam release signal (e.g. "Low" signal) is adapted to be fed to the side of the copying apparatus by the actuation of the jam reset switch SW3, whereby the copying function is automatically effected from the state prior to stopping, thus preventing wasteful copying.

As is clear from the foregoing description, in the sorter according to the present invention, since the means for memorizing the sorter positions for the respective copy paper sheets is provided at the sorter side itself, the sorting function may be resumed from the state before the jamming upon starting the sorting function in the case of jamming or running out of paper sheets at the copying apparatus side, and therefore, the operation thereof has been markedly simplified. Furthermore, since no signal is transmitted from the side of the copying apparatus main body, not only the attaching or detaching of the sorter itself is facilitated, but malfunctions thereof by the possible transmission of erroneous signals may be simultaneously prevented.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. In a sorter for accommodating copy paper sheets which is arranged to receive copy paper sheets from a copying apparatus main body for classification and successive accommodation thereof onto a large number of trays, the improvement comprising:

a memory means for storing information regarding the location of the next tray to receive a sheet of the copy sheets being supplied to said trays;

a control means for automatically reading out of said memory means the location of the next trays to receive a sheet of the copy sheets in cases of troubles such as paper jamming or expiration out of copy paper sheets;

a change-over switch for setting the sorter selectively into a sort mode or a non-sort mode;

a reset switch for the sorter jamming and restoring the sorting function;

said control means includes a control circuit responsive to the change-over switch setting selecting the sort mode or the nonsort mode;

a jam timer for storing a predetermined processing time and developing a jam timer signal;

a sensor for detecting the passage of a copy paper sheet and developing a signal; and a paper sheet interval timer for storing a predetermined delivery time and developing a paper sheet interval timer signal;

said sensor detects the presence or absence of a copy paper sheet from said copying apparatus to said trays and supplies said signal to said memory means, upon detection of a copy paper sheet said memory means compares said signal with said paper sheet interval timer signal to determine if the predetermined delivery time has lapsed and to said jam timer signal to determine if said predetermined processing time has lapsed for detecting a paper jam or the expiration of copy paper sheets;

said control circuit includes a main control circuit, an input control circuit and a drive control circuit operatively coupled with said main control circuit, said main control circuit applying a strobe signal to said input control circuit for developing an input signal from said input control circuit, said main control circuit applying control signals corresponding to the state of input to said drive control circuit, whereby said drive control circuit drives and controls a jam light emitting diode, driving solenoids for gate claws and a motor, for sequentially changing the tray to which copy paper sheets are supplied.

2. A sorter according to claim 1, wherein "0" is stored in a designated area of said memory means for indicating the non-sort mode and a processing for the non-sort mode is effected, and "1" is stored in the designated area of said memory means upon setting said change-over switch to said sort mode.

3. A sorter according to claim 2, wherein said predetermined processing time of said jam timer is approximately 2.5 seconds.

4. A sorter according to claim 2, wherein said predetermined delivery time of said paper sheet interval timer is approximately 4.6 second.

5. A sorter according to claim 2, and further including a second sensor for detecting the passage of copy paper sheet into one of said trays and developing a signal supplied to said memory means and compared to said jam timer signal to determine if said predetermined processing time has lapsed for detecting a paper jam.

* * * * *